US010913568B2

(12) United States Patent
Sollie et al.

(10) Patent No.: US 10,913,568 B2
(45) Date of Patent: Feb. 9, 2021

(54) STORAGE BOX WITH SECURABLE TRAY

(71) Applicant: Pratt Corrugated Holdings, Inc., Conyers, GA (US)

(72) Inventors: Greg Sollie, Sharpsburg, GA (US); Paul Ott, Atlanta, GA (US); Jamie Waltermire, Peachtree City, GA (US); Shifeng Chen, Newport News, VA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 0 days.

(21) Appl. No.: 16/028,033

(22) Filed: Jul. 5, 2018

(65) Prior Publication Data

US 2020/0010236 A1 Jan. 9, 2020

(51) Int. Cl.

| | |
|---|---|
| ***B65D 5/12*** | (2006.01) |
| ***B65D 5/68*** | (2006.01) |
| ***B65D 5/46*** | (2006.01) |
| ***B65D 5/42*** | (2006.01) |

(52) U.S. Cl.

CPC ..... *B65D 5/46016* (2013.01); *B65D 5/12* (2013.01); *B65D 5/4266* (2013.01); *B65D 5/685* (2013.01); *B65D 2301/10* (2013.01)

(58) Field of Classification Search

CPC ..... B65D 5/12; B65D 5/321; B65D 5/326; B65D 5/685; B65D 5/46016; B65D 55/02; B65D 11/1806; B65D 5/38

USPC .... 229/122.29, 122.27, 128.28, 125.29, 161, 229/125.38, 155, 117.11

See application file for complete search history.

(56) References Cited

U.S. PATENT DOCUMENTS

| | | | | |
|---|---|---|---|---|
| 696,928 | A | 4/1902 | Beecher | |
| 2,537,801 | A | 1/1951 | Swatsick | |
| 2,618,429 | A | 11/1952 | Donnell | |
| 2,718,996 | A * | 9/1955 | Jamieson | B65D 5/12 229/110 |
| 2,736,486 | A * | 2/1956 | Rabby | B65D 5/10 229/117.18 |
| 2,765,112 | A * | 10/1956 | Derman | A63H 33/00 229/122.21 |
| 2,822,973 | A | 2/1958 | Armstrong et al. | |
| 3,058,643 | A | 10/1962 | Wilson | |

(Continued)

FOREIGN PATENT DOCUMENTS

| | | |
|---|---|---|
| DE | 3517176 | 11/1986 |
| DE | 19741540 | 3/1999 |
| FR | 2449603 | 9/1980 |

OTHER PUBLICATIONS

Office Supply Hut; Article entitled: "Bankers Box Recycled Stor/File—Letter/Legal", located at <http://www.officesupplyhut.com/Products/Bankers-Box-Recycled-StorFileandtrade----LetterLegal__FEL12770.aspx>, Accessed Feb. 22, 2018, 4 pgs.

(Continued)

*Primary Examiner* — Nathan J Newhouse
*Assistant Examiner* — Phillip D Schmidt
(74) *Attorney, Agent, or Firm* — Taylor English Duma LLP

(57) ABSTRACT

Example aspects of a storage box and a method for assembling a storage box are disclosed. The storage box can comprise a sidewall enclosure, the enclosure defining a top edge and an opposing bottom edge, a fastener extending from the bottom edge, and a tray, the fastener coupling the tray to the sidewall enclosure.

28 Claims, 7 Drawing Sheets

(56) References Cited

U.S. PATENT DOCUMENTS

| | | | | |
|---|---|---|---|---|
| 3,303,986 | A | 2/1967 | Tanaka | |
| 3,438,562 | A | 4/1969 | Connor et al. | |
| 3,782,619 | A * | 1/1974 | Dittbenner | B65D 5/321 206/527 |
| 4,030,600 | A | 6/1977 | Heaps | |
| 4,089,417 | A * | 5/1978 | Osborne | B65D 19/20 108/56.1 |
| 4,199,832 | A | 4/1980 | Glasscock et al. | |
| 4,504,497 | A | 3/1985 | Kurth et al. | |
| 4,717,070 | A | 1/1988 | Taub | |
| 4,927,074 | A | 5/1990 | Larue et al. | |
| 4,948,033 | A | 8/1990 | Halsell, II et al. | |
| D315,098 | S | 3/1991 | Hutcheson | |
| D339,062 | S | 9/1993 | Williams | |
| 5,305,950 | A | 4/1994 | Oppenheim | |
| 5,328,042 | A * | 7/1994 | Heise | B65D 5/12 220/4.28 |
| 5,699,959 | A | 12/1997 | Huspeka et al. | |
| D398,228 | S | 9/1998 | Herbst et al. | |
| D398,230 | S | 9/1998 | Herbst et al. | |
| D424,117 | S | 5/2000 | Steinbeck et al. | |
| 7,134,927 | B1 * | 11/2006 | Johnson | A63B 31/11 441/64 |
| 7,841,512 | B2 | 11/2010 | Westerman et al. | |
| D643,714 | S | 8/2011 | Daley et al. | |
| D664,312 | S | 7/2012 | Bizzle | |
| D673,368 | S | 1/2013 | Scott | |
| 8,720,736 | B2 | 5/2014 | Boland | |
| D740,564 | S | 10/2015 | Scott | |
| D749,944 | S | 2/2016 | Kummerfeldt | |
| 10,011,386 | B2 | 7/2018 | Lee | |
| 10,106,290 | B2 | 10/2018 | Couture | |
| D840,806 | S | 2/2019 | Bourke | |
| D854,830 | S | 7/2019 | Criste et al. | |
| D877,614 | S | 3/2020 | Sollie et al. | |
| D885,177 | S | 5/2020 | Sevsek | |
| 2015/0353270 | A1 * | 12/2015 | Gaul | B65D 19/20 206/409 |

OTHER PUBLICATIONS

Rajapack; Article entitled: "Cardboard cap and sleeve loading cases without pallets", located at <https://www.rajapack.co.uk/cardboard-boxes/export-boxes/cardboard-cap-sleeve-loading-cases-without-pallets_PDT04683.html>, Accessed Feb. 22, 2018, 2 pgs.

The Custom Boxes; Article entitled: "Cardboard Boxes", located at <https://www.thecustomboxes.com/cardboard-boxes/>, Accessed on Feb. 22, 2018, 1 pg.

Sollie, Greg; Notice of Allowance for U.S. Appl. No. 29/655,643, filed Jul. 5, 2018, dated Nov. 12, 2019, 5 pgs.

Sollie, Greg; Supplemental Notice of Allowance for U.S. Appl. No. 29/655,643, filed Jul. 5, 2018, dated Feb. 3, 2020, 10 pgs.

Bankers Box SmoothMove Moving. [online] Published on Nov. 1, 2012. Retrieved Jul. 29, 2019 from URL: https://www.target.com/p/bankers-box-17 4-smoothmove-moving-storage-box-extra-strength-large-18w-x-18d-x-24h-kraft/-/A-16942594, 3 pgs.

Sollie, Greg; Ex Parte Quayle Action for U.S. Appl. No. 29/655,643, filed Jul. 5, 2018, mailed Aug. 20, 2019, 11 pgs.

Sollie, Greg; Notice of Allowance for Design U.S. Appl. No. 29/721,896, filed Jan. 24, 2020, dated Nov. 24, 2020, 23 pgs.

* cited by examiner

STORAGE BOX WITH SECURABLE TRAY

TECHNICAL FIELD

This disclosure relates to storage boxes. More specifically, this disclosure relates to a storage box comprising a securable tray.

BACKGROUND

Storage boxes can be used to store items, such as documents, in office and home environments. A common type of storage box is a bankers box. A bankers box comprises a sidewall enclosure, a base panel having a plurality of side edges, and a base support assembly. One of the side edges of the base panel is attached to the sidewall enclosure, with the remaining side edges unattached. The base support assembly comprises a support panel configured to reinforce the base panel and one or more support flaps configured to frictionally engage the sidewall enclosure. However, the passive engagement between the support flaps and the sidewall enclosure can be overcome by a minimal amount of force. Thus, the weight capacity of the box is limited.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts off the disclosure as an introduction to the following complete and extensive detailed description.

Disclosed is a storage box comprising a sidewall enclosure, the enclosure defining a top edge and an opposing bottom edge, a fastener extending from the bottom edge, and a tray, the fastener coupling the tray to the sidewall enclosure.

Also disclosed is a storage box comprising a sidewall enclosure, the enclosure defining a top edge and an opposing bottom edge, the bottom edge defining a first section and an opposing second section, a first fastener extending from the first section, a second fastener extending from the second section; and a tray abutting the bottom edge of the sidewall enclosure, the tray comprising a first pair of fastener slots and a second pair of fastener slots, the first fastener engaging the first pair of fastener slots, the second fastener engaging the second pair of fastener slots.

Also disclosed is a method assembling a storage box comprising the steps of forming a sidewall enclosure; forming a tray, the tray defining a first slot and a second slot; inserting a fastener through the first slot; and inserting a portion of the fastener through the second slot.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
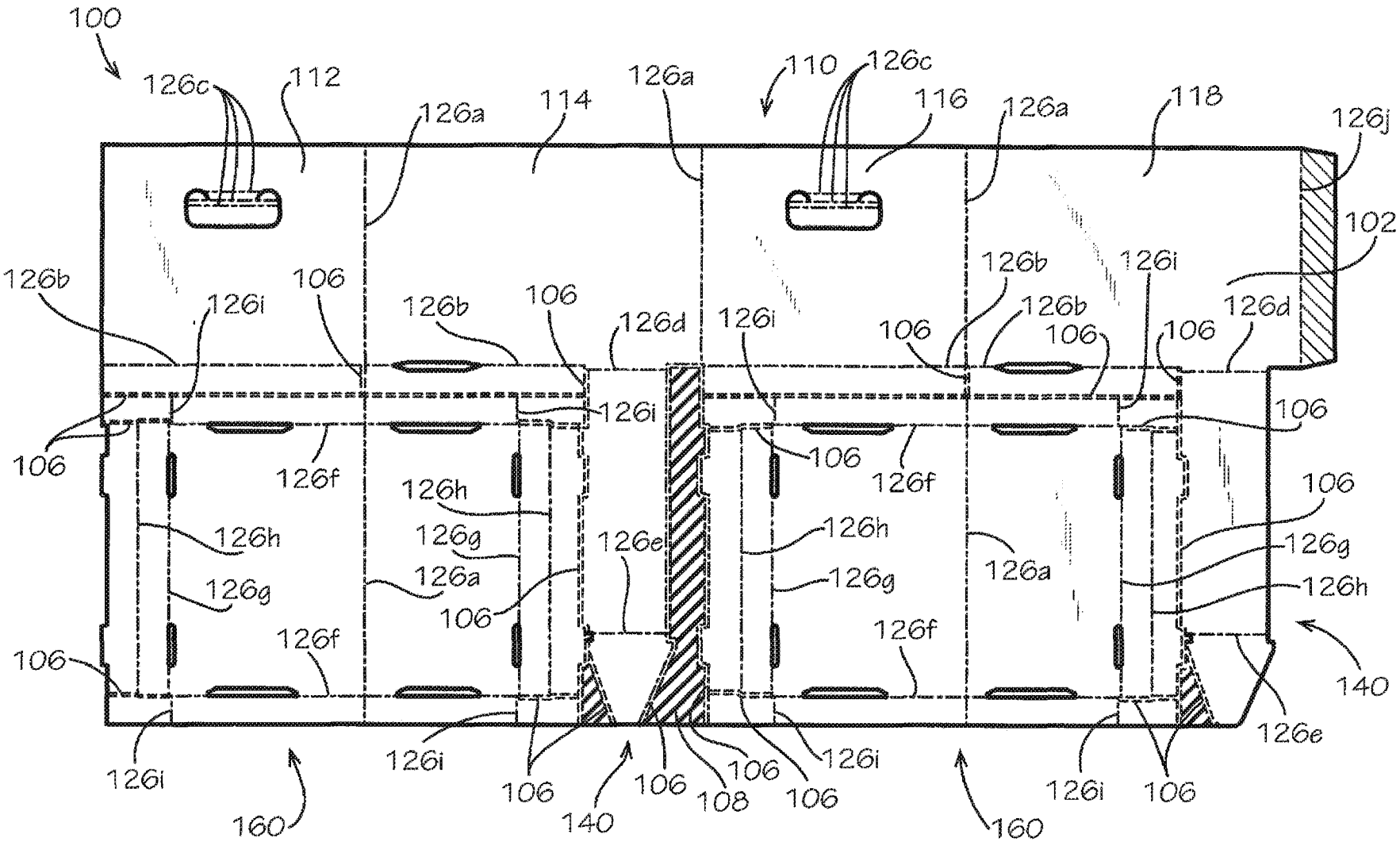
FIG. 1 is a schematic view of a blank formable into a box comprising a main body and a pair of trays, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed in the present application is a storage box and associated methods, systems, devices, and various apparatus. Example aspects of the storage box can comprise a main body and a pair of trays. The main body can comprise a pair of fasteners for coupling the main body to one of the pair of trays. It would be understood by one of skill in the art that the disclosed storage box is described in but a few exemplary aspects among many. No particular terminology or description should be considered limiting on the disclosure or the scope of any claims issuing therefrom.

Figure 9:
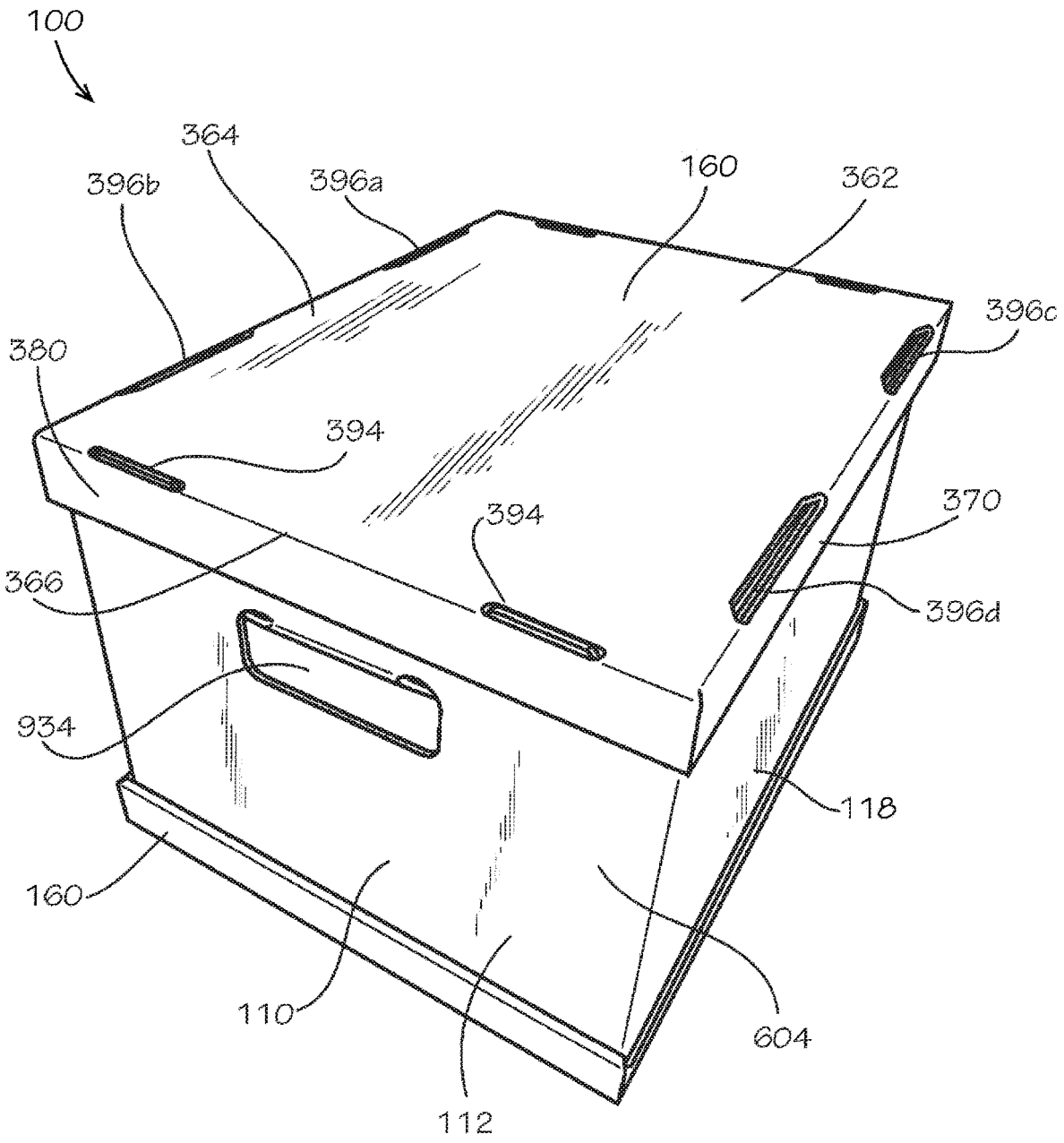
FIG. 9 is a perspective view of the assembled main body of FIG. 4 fully engaged with a pair of the assembled trays of FIG. 5.

FIG. 1 illustrates a first aspect of the storage box 100 in blank form, according to the present disclosure. As shown, the storage box 100 can comprise the main body 110, and the main body 110 can comprise four sidewalls 112, 114, 116, 118. Each of the fasteners 140 can extend from one of the sidewalls 114,118. The storage box 100 can further comprise the pair of trays 160. According to example aspects, the storage box 100 can define an inner surface 102 and an outer surface 604 (shown in FIG. 6). Example aspects of the storage box 100 can be formed from paperboard (e.g., corrugated cardboard). Other example aspects can comprise another material, or a combination of materials, including, but not limited to, metal, plastic, wood, paper, fiberboard, containerboard, or any other suitable material known in the art. According to the example aspect of FIG. 1, the main body 110 and the pair of trays 160 can be formed together as a single blank. The storage box 100 can comprise tear lines 106 (indicated by double dashed lines) formed along the edges of the main body 110 and each of the trays 160 to facilitate detachment of the main body 110 and pair of trays 160 from one another. The tear lines 106 can comprise a series of perforations formed in the paperboard material that can facilitate tearing along the tear lines 106. The storage box 100 can further comprise bend lines 126*a-j* (indicated by dashed lines) that can facilitate folding of the storage box 100 during assembly. Example aspects of the bend lines 126*a-j* can be formed by a crease in the material. In other aspects, bend lines 126*a-j* can be formed by perforations, scoring, creases, or any other suitable technique for forming bend lines that is known in the art. Forming the storage box 100 as a blank can allow the storage box 100 to remain in a flat configuration, as shown in FIG. 1, and taking up minimal space until it is assembled for use, as shown in FIG. 9. Some example aspects of the storage box 100 in blank form can comprise scrap pieces 108 (indicated by shading). Optionally, the scrap pieces 108 can be discarded after the main body 110 and the pair of trays 160 are detached from one another.

Figure 2:
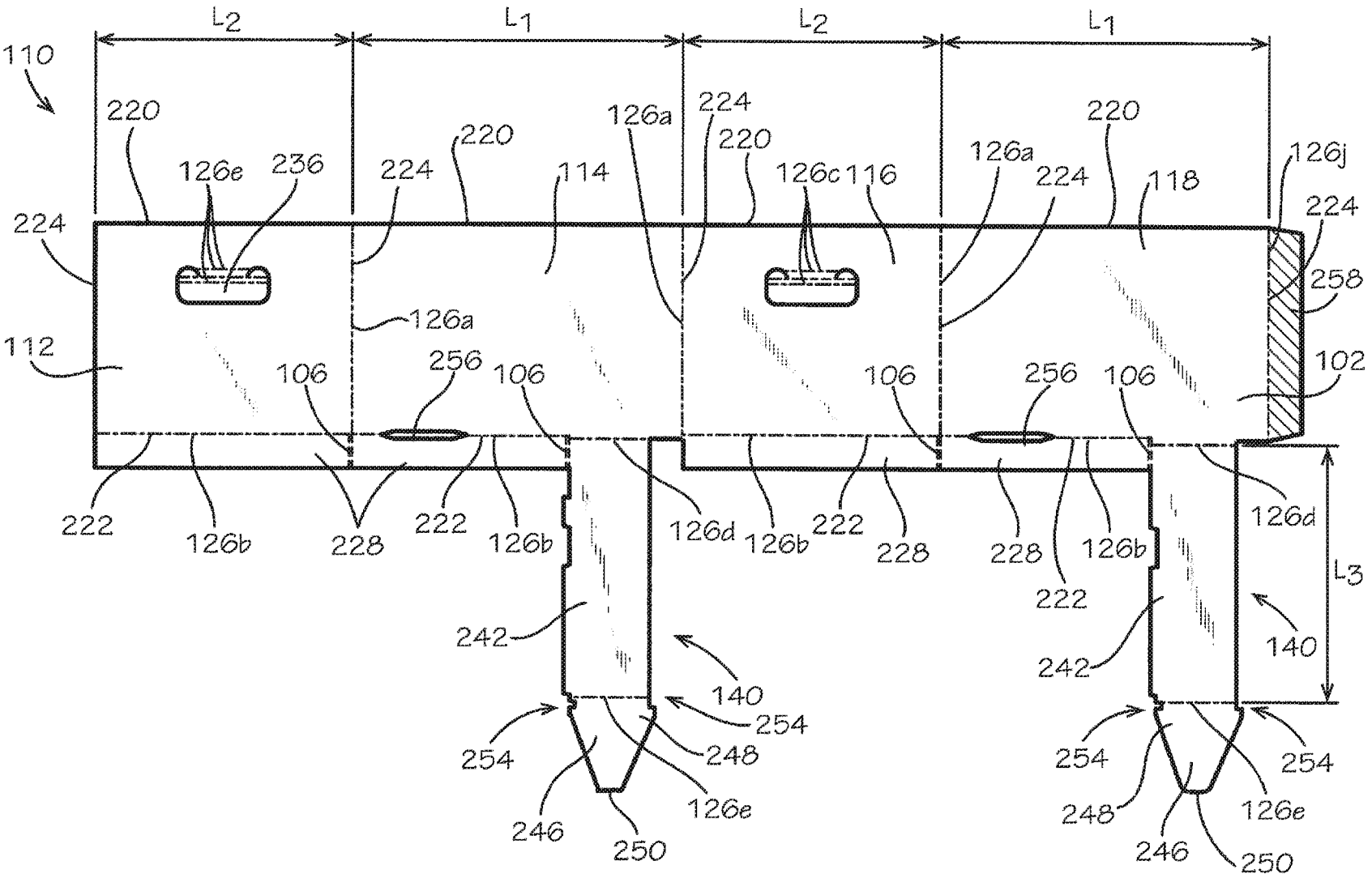
FIG. 2 is a schematic view of the main body of FIG. 1.
Figure 4:
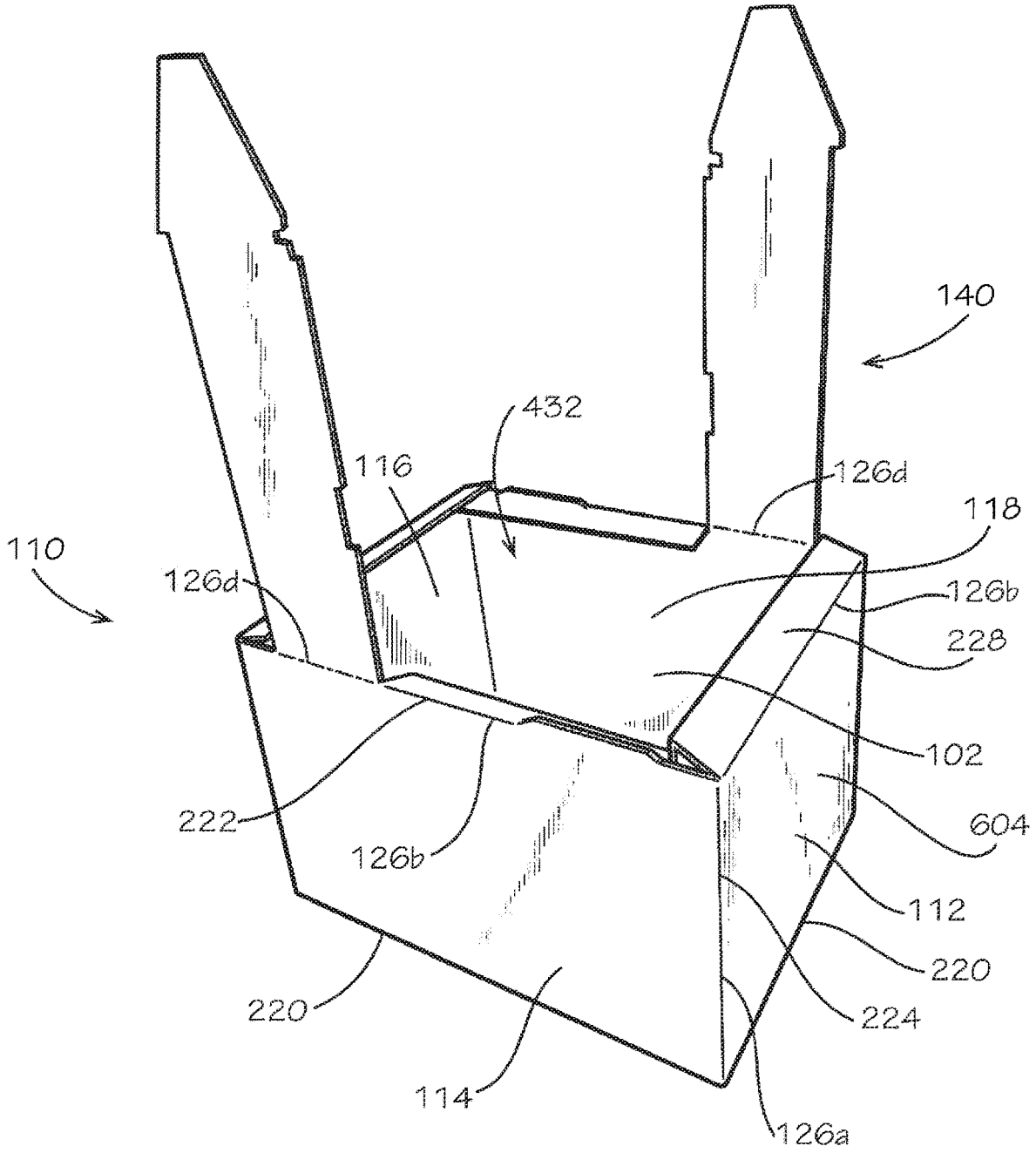
FIG. 4 is a perspective view of the main body of FIG. 1 in an assembled state.

FIG. 2 illustrates the main body 110 of the storage box 100 in blank form, detached from the pair of trays 160 (shown in FIG. 1). Each of the sidewalls 112,114,116,118 can define a top edge 220, a bottom edge 222, and a pair of side edges 224. References of top and bottom in this disclosure can refer to the storage box 100 in its assembled and operable state, as shown in FIG. 9. The sidewalls 112,114,116,118 can be connected to one another by bend lines 126*a* formed in the paperboard material along the side edges 224 of the sidewalls 112,114,116,118. A bottom flap 228 can extend from the bottom edge 222 of each of the sidewalls 112,114,116,118 and can be connected to the corresponding sidewall 112,114,116,118 by a bend line 126*b*. The bend lines 126*b* can allow the bottom flaps 228 to fold relative to the corresponding sidewalls 112,114,116, 118. According to example aspects, the bottom flaps 228 extending from sidewalls 112,116 can extend along the full length of the corresponding bottom edge 222, while the bottom flaps 228 extending from sidewalls 114,118 can extend along a partial length of the corresponding bottom edge 222. As illustrated, example aspects of sidewalls 114, 118 can define a generally rectangular shape and example aspects of sidewalls 112,116 can define a generally square shape. As such, sidewalls 114,118 can define a length $L_1$ that can be greater than a length $L_2$ of the sides wall 112,116. Example aspects of the main body 110 of the storage box 100, when assembled (as shown in FIG. 4), can generally define a rectangular prism comprising an open top side (not shown) and an open bottom side 432 (shown in FIG. 4). One of ordinary skill in the art will appreciate that, in other example aspects, the storage box 100 can comprise more or fewer sidewalls 112,114,116,118, and that the main body 110, when assembled, can define another shape, such as, for example, a cube.

As shown, sidewall 112 can be oriented at a first end of the series of sidewalls 112,114,116,118, and sidewall 118 can be oriented at an opposite, second end of the series of sidewalls 112,114,116,118. Sidewall 118 can comprise a connector strip 258 extending along one of the side edges 224 thereof, as shown. The connector strip 258 can be connected to the side edge 224 by a bend line 126*j*. The connector strip 258 can be attached to sidewall 112 during assembly of the storage box 100. In one example aspect, the connector strip 258 can be attached to the sidewall 112 by a fastener, such as glue. In other example aspects, the connector strip 258 can be attached to the sidewall 112 by another suitable fastener know in the art, including, for example, tape, staples, and the like.

Handle openings 934 (shown in FIG. 9) can be formed in one or more of the sidewalls 112,114,116,118. For example, in one aspect, handle openings 934 can be formed in sidewalls 112,116. The handle openings 934 can be configured to allow the passage of a user's hand therethrough. Example aspects of the handle openings 934 can be partially or fully covered by a handle flap 236, as shown. Each handle flap 236 can close or partially close the corresponding handle opening 934, to shield the interior contents of the storage box 100 from external factors, such as dust, moisture, etc. Example aspects of the handle flaps 236 can be connected to the sidewalls 112,116 via bend lines 126*c* adjacent the corresponding handle opening 934. The bend lines 126*c* can allow each of the handle flaps 236 to fold towards the interior of the assembled storage box 100 when a hand is inserted into the corresponding handle opening 934, thus forming handles that can allow a user to lift and transport the storage box 100 as needed.

Each of the fasteners 140 can extend from the bottom edge 222 of one of the sidewalls 112,114,116,118 of the main body 110. For example, as illustrated in FIG. 1, a first one of the pair of fasteners 140 can extend from sidewall 114, and a second one of the pair of fasteners 140 can extend from sidewall 118. Each of the fasteners 140 can comprise a crosspiece 242 connected to and extending from the corresponding sidewall 114,118 and a fastener tab 246 connected to the crosspiece 242 and distally located from the corresponding sidewall 114,118. The crosspiece 242 can be formed as a generally rectangular strip defining a length $L_3$. The length $L_3$ of the crosspiece 242 can approximately equal the length $L_2$ of the sidewalls 112,116, according to example aspects. Example aspects of the crosspieces 242 can be connected to the corresponding sidewalls 114,118 at a bend line 126*d* formed at the bottom edge 222 of the sidewalls 114,118.

According to example aspects, each of the fastener tabs 246 can define a first end 248 coupled to and extending from the crosspiece 242 and a second end 250 opposite the first end 248. Each of the fastener tabs 246 and can taper inward from their first end 248 to their second end 250, such that the fastener tabs 246 define a generally trapezoidal shape. In other aspects, the fastener tabs 246 can define another shape, such as, for example, square, rectangle, triangle, etc. Each of the fastener tabs 246 can be connected to the corresponding crosspiece 242 by bend lines 126*e*, such that the fastener tab 246 can fold with respect to the crosspiece 242. Further, example aspects of each fastener 140 can define a lip and/or notch 254 formed at each side of the bend line 126*e* between the crosspiece 242 and the fastener tab 246. For example, a notch can be formed at a left side of the bend line 126*e*, relative to the orientation shown, and a lip can be formed at a right side of the bend line 126*e*.

According to example aspects, as shown in FIG. 2, each of the sidewalls 114,118 can also define a fastener slot 256 formed therethrough, at or near the bend lines 126*b* formed between the sidewalls 114,118 and the corresponding bottom flaps 228. Further, according to example aspects, each of the fastener slots 256 can be spaced apart from the fasteners 140 extending from the bottom edges 222 of the corresponding sidewalls 114,118. Example aspects of each of the fastener slots 256 can be sized and shaped to receive one of the fastener tabs 246, as will be described in further detail below.

Figure 3:
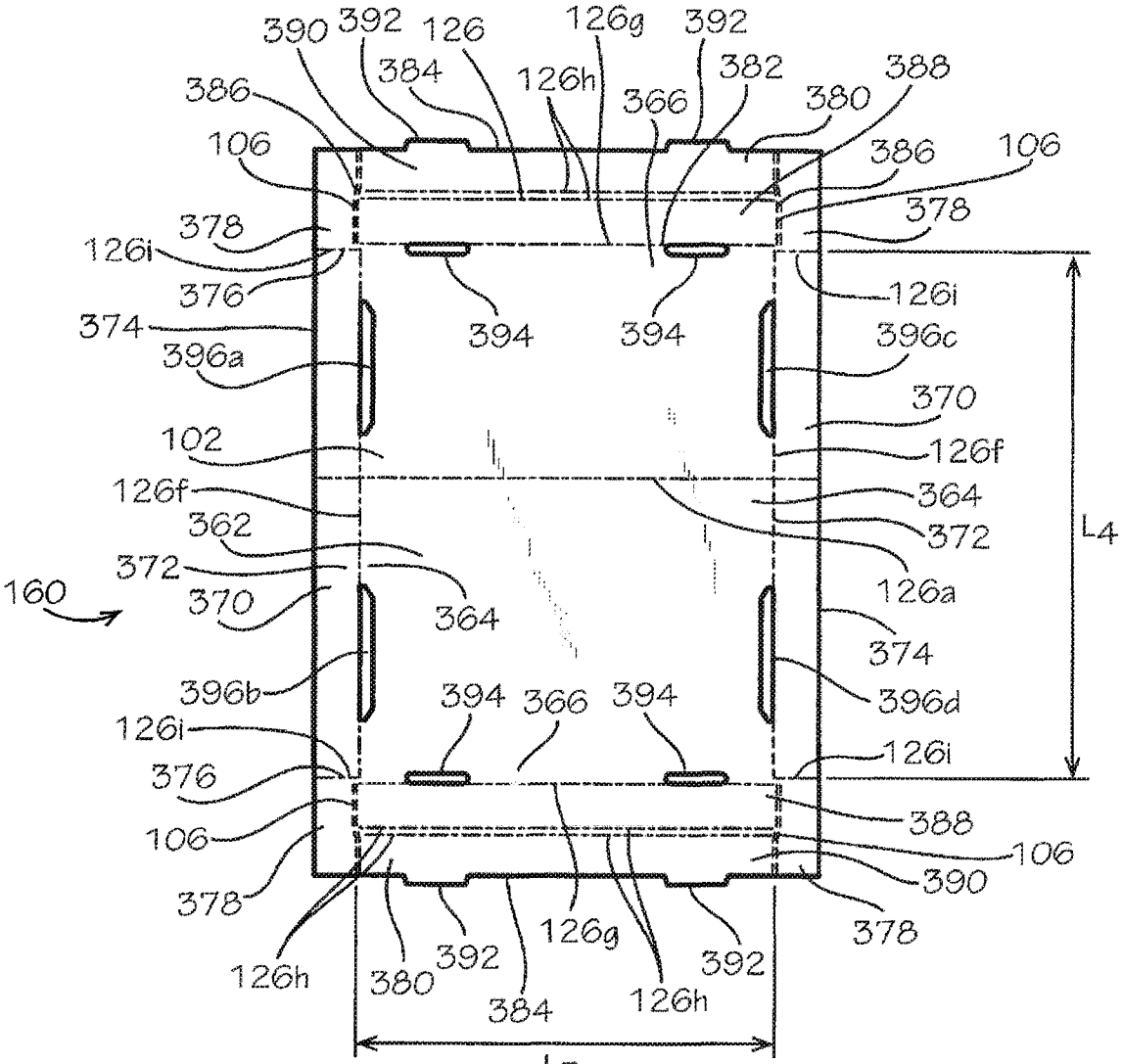
FIG. 3 is a schematic view of one of the trays of FIG. 1.

FIG. 3 illustrates one of the pair of trays 160 in blank form. Example aspects of the pair of trays 160 can be substantially similar to one another. Each of the trays 160 can comprise a center panel 362. The center panel 362 of the tray 160 can define a pair of opposing side edges 364 and a pair of opposing end edges 366. The side edges 364 can define a length $L_4$ that can be approximately equal to, or slightly larger than, the length $L_1$ of sidewalls 114,118, and the end edges 366 can each define a length $L_5$ that can be approximately equal to, or slightly larger than, the length $L_2$ of sidewalls 112,116. As such, example aspects of the center panel 362 can define a rectangular shape comprising dimensions similar to the rectangular cross-section of the assembled main body 110 (shown in FIG. 4). Further, example aspects of the center panel 362 can comprise one of the bend lines 126*a* extending across the center panel 362 parallel to the side edges 364 of the center panel 362. As shown in FIG. 1, each bend line 126*a* extending across the center panel 362 of one of the trays 160 can be a continuation of one of the bend lines 126*a* formed along the side edges 224 of the sidewalls 112,114,116,118. The bend lines 126*a* across the center panels 362 can be formed during manufacturing due to the formation of the bend lines 126*a* between sidewalls 112,114,116,118, and in some aspects, the bend lines 126*a* across the center panels 362 can serve no purpose. In other aspects, a bend lines 126*a* do not extend across the center panels 362.

A side panel 370 can extend from each of the side edges 364 of the center panel 362, and an end panel 380 can extend from each of the end edges 366 of the center panel 362. Each of the side panels 370 can be generally rectangular in shape and can comprise an inward edge 372, an outward edge 374, and a pair of opposing side edges 376. The inward edge 372 of each side panel 370 can be connected to a side edge 364 of the center panel 362. According to example aspects, the bend line 126*a* extending across the center panel 362 can also extend across each side panel 370 from the inward edge 372 to the outward edge 374. Each of the end panels 380 can be generally rectangular in shape and can define an inward edge 382, an outward edge 384, and a pair of opposing side edges 386. An inward edge 382 of each end panel 380 can be connected to an end edge 366 of the center panel 362. According to example aspects, bend lines 126*f* can be formed at the connection of each of the side panels 370 to the center panel 362, such that each of the side panels 370 can fold relative to the center panel 362. Furthermore, bend lines 126*g* can be formed at the connection of each of the end panels 380 to the center panel 362, such that each of the end panels 380 can fold relative to the center panel 362. Moreover, example aspects of each end panel 380 can comprise a first section 388 and an adjacent second section 390. Each of the first sections 388 can be connected to the corresponding second section 390 by a pair of bend lines 126*h*, as shown, to facilitate folding of the second section 390 relative to the first section 388 during assembly. Example aspects of the bend lines 126*h* can extend in a direction that can be parallel to the inward and outward edges 382,384 of the end panel 380. In another aspect, a single bend line 126*h* can be formed between the first and second sections 388,390.

Example aspects of each side panel 370 can comprise a pair of opposing side flaps 378 extending from opposing side edges 376 of the side panel 370. As shown, the side flaps 378 can be oriented adjacent the side edges 386 of the end panels 380. The side flaps 378 can be connected to the side panels 370 by bend lines 126*i*. In the blank form, as shown, example aspects of the side flaps 378 can be connected to the side edges 386 of the end panels 380 by tear lines 106 that can be torn during assembly of the storage box 100. Further, example aspects of each end panel 380 can comprise a pair of connector tabs 392, each connector tab 392 extending from the outward edge 384 of the end panel 380. As shown, example aspects of the connector tabs 392 can be spaced apart along the outward edges 384 of the end panels 380. A pair of corresponding connector slots 394 can be formed at or near each of the end edges 366 of the center panel 362, at or near the corresponding bend lines 126*g*. The connector slots 394 can be vertically aligned with the connector tabs 392, relative to the orientation shown, and can be sized and shaped to receive the connector tabs 392 therein.

Example aspects of the tray 160 can further comprise a first pair of fastener slots 396*a*,396*b* formed at or near a first one of the side edges 364 of the center panel 362, and a second pair of fastener slots 396*c*,396*d* can be formed at or near a second one of the side edges 364 of the center panel 362. Each of the fastener slots 396*a-d* can be sized and shaped to receive one of the fastener tabs 246 of the fasteners 140. As shown in FIG. 3, example aspects the first pair of fastener slots 396*a*,396*b* can be generally vertically aligned, and the second pair of fastener slots 396*c*,396*d* can be generally vertically aligned, relative to the orientation shown. Further, opposing fastener slots 396*a* and 396*c* can be generally horizontally aligned, and opposing fastener slots 396*b*,396*d* can be generally horizontally aligned, relative to the orientation shown. Moreover, according to example aspects, fastener slot 396*a* can be oriented diagonally to fastener slot 396*d*, and fastener slot 396*b* can be oriented diagonally to fastener slot 396*c*, relative to the orientation shown.

Figure 5:
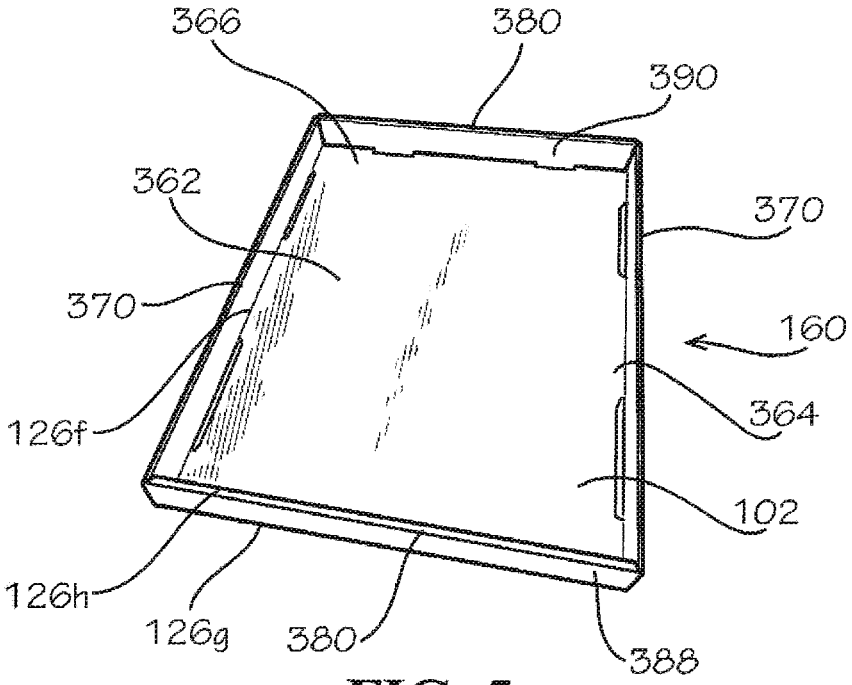
FIG. 5 is a perspective view of one of the trays of FIG. 1 in an assembled state.

Example aspects of the main body 110 and one of the pair of trays 160 in an assembled form are illustrated in FIGS. 4 and 5, respectively. Referring to FIG. 4, the assembled main body 110 is shown with the top edges 220 of the sidewalls 112,114,116,118 facing downward and the bottom edges 222 facing upward, relative to the orientation shown, such that the open bottom side 432 of the assembled main body 110 can be visible. As illustrated, each of the sidewalls 112,114, 116,118 can be folded along the bend lines 126*a* extending along their side edges 224. According to example aspects of the assembled main body 110, each of the sidewalls 112, 114,116,118 can be oriented approximately perpendicular to each adjacent sidewall 112,114,116,118 to define a rectangular prism. The main body 110 can be retained in this configuration by the attachment of the connector strip 258 (shown in FIG. 2) on side panel 118 to the inner surface 102 of side panel 112. In other aspects, the connector strip 258 can be attached to the outer surface 604 of the side panel 112. Further, the bottom flaps 228 extending from the bottom edges 222 of the sidewalls 112,114,116,118 can be folded along the bend lines 126*b* formed therebetween and can be oriented approximately perpendicular to the sidewalls 112,114,116,118. The fasteners 140 connected to the bottom edges 222 of sidewalls 114,118 can be substantially coplanar with the sidewalls 114,118 and can extend generally upwardly therefrom, relative to the orientation shown. Moreover, the fasteners 140 can be oriented diagonally to one another, relative to the orientation shown.

FIG. 5 illustrates one of the pair of trays 160 in the assembled form. The tray 160 is shown with the outer surface 604 (shown in FIG. 6) of the center panel 362 facing downward and the inner surface 102 of the center panel 362 facing upwards, relative to the orientation shown. Each of the side panels 370 extending from the corresponding side edges 364 of the center panel 362 can be folded along the bend lines 126*f* formed therebetween and can be oriented approximately perpendicular to the center panel 362. Furthermore, each of the end panels 380 extending from the end edges 366 of the center panel 362 can be folded along the bend lines 126*g* formed therebetween and can be oriented approximately perpendicular to the center panel 362. According to example aspects, each of the side flaps 378 (shown in FIG. 3) of the side panels 370 can be folded along the bend lines 126*i* formed between the side flaps 378 and the side panels 370, such that the side flaps 378 can be oriented at approximately 90° with respect to the side panels 370. The outer surface 604 (shown in FIG. 6) of each side flap 378 can abut the inner surface 102 of the first section 388 of an adjacent end panel 380. Further, the second section 390 of each end panel 380 can be folded over the pair of corresponding side flaps 378, such that the corresponding side flaps 378 are disposed between the corresponding first section 388 and second section 390. Moreover, the connector tabs 392 (shown in FIG. 3) extending from the second section 390 of each end panel 380 can be inserted into the corresponding connector slots 394 (shown in FIG. 3) located on the center panel 362, to retain the second section 390 of each end panel 380 in the folded configuration with respect to the first section 388, and to retain the corresponding side flaps 378 between the first and second sections 388,390.

Figure 6:
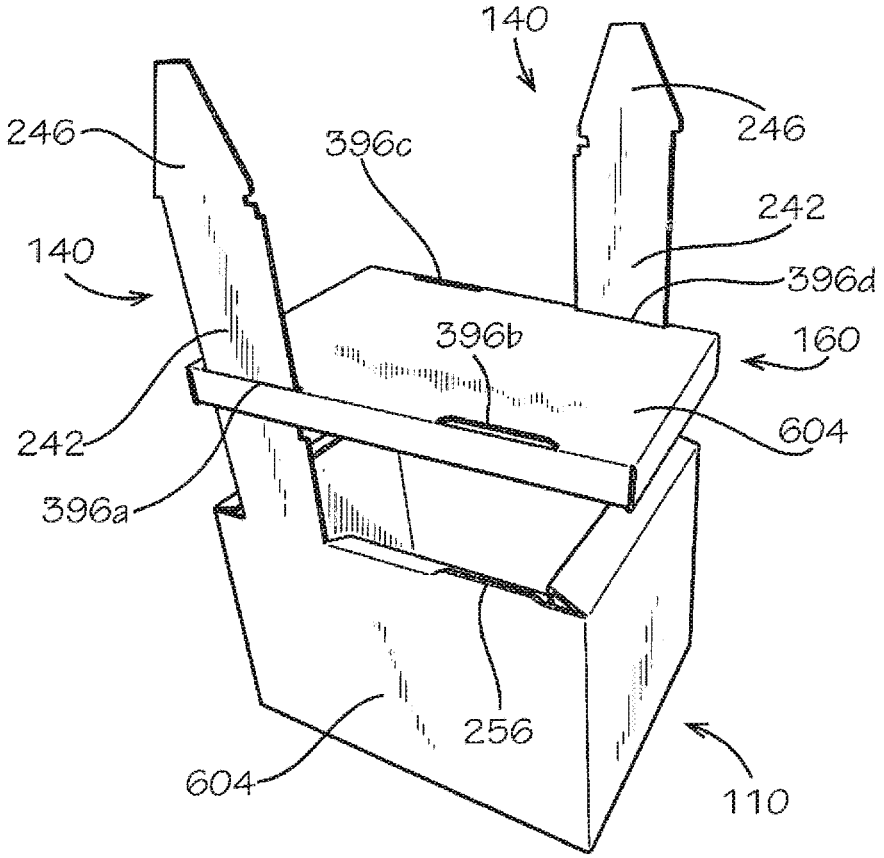
FIG. 6 is a perspective view of the assembled main body of FIG. 4 partially engaged with the assembled tray of FIG. 5.

FIG. 6 illustrates a step in the assembly of one of the trays 160 to the main body 110. A first one of the fasteners 140 can be inserted through the fastener slot 396*a* and a second one of the fasteners 140 can be inserted through the diagonal fastener slot 396*d*. As shown, in-mid assembly, each of the fastener tabs 246 of the fasteners 140 can be been fully inserted through the corresponding fastener slots 396*a*,396*d*, and each of the crosspieces 242 of the fasteners 140 can be partially inserted through the corresponding fastener slot 396*a*,396*d*. In a next step, the crosspieces 212 can be fully inserted through the corresponding fastener slots 396*a*,396*d*. Further, as shown, the fastener slots 396*b*, 396*c* of the tray 160 can be configured to align with the fastener slots 256 of the main body 110 when the tray 160 is assembled to the main body 110.

Figure 7:
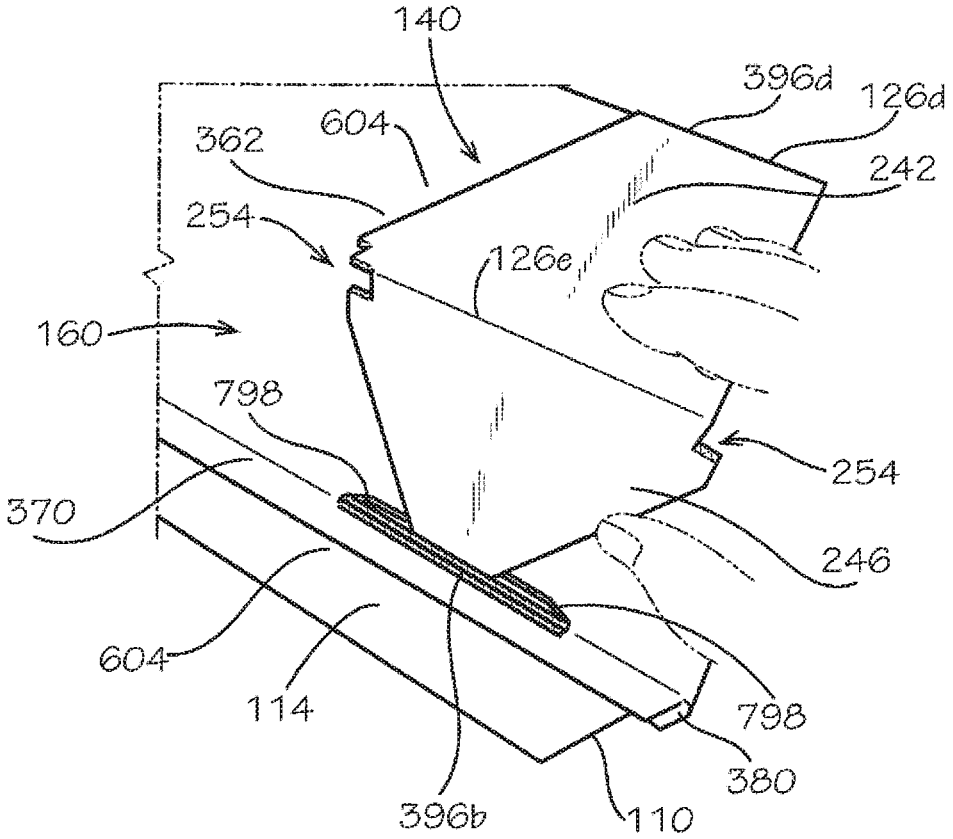
FIG. 7 is a perspective view of a fastener for securing the assembled main body of FIG. 4 to the assembled tray of FIG. 5.

FIG. 7 illustrates one of the fasteners 140 fully inserted through the corresponding fastener slot 396*d*. When the fasteners 140 are fully inserted through the corresponding fastener slots 396*a*,396*d*, the bottom flaps 228 (shown in FIG. 2) of the main body 110 can abut the inner surface 102 (shown in FIG. 1) of the center panel 362. Further, the side panels 370 and end panels 380 of the tray 160 can abut or be positioned adjacent to the outer surface 604 of the sidewalls 112,114,116,118. FIG. 7 illustrates a side panel 370 of the tray 160 abutting the outer surface 604 of sidewall 114. To secure the tray 160 to the main body 110, the crosspiece 242 of the fastener 140 can fold with respect to the corresponding sidewall 118 (shown in FIG. 2) along the bend line 126*d* formed between the crosspiece 242 and the sidewall 118. The crosspiece 242 can fold towards and abut the outer surface 604 of the center panel 362, reinforcing the center panel 362. The fastener tab 246 can fold with respect to the crosspiece 242 along the bend line 126*e* formed between the crosspiece 242 and the fastener tab 246, and the fastener tab 246 can be inserted through the opposing fastener slot 396*b* in the tray 160 and a corresponding one of the fastener slots 256 (shown in FIG. 2) in the main body 110. End edges 798 of the fastener slots 396*b*,256 can engage the notches and/or lips 254 formed at the bend lines

Figure 8:
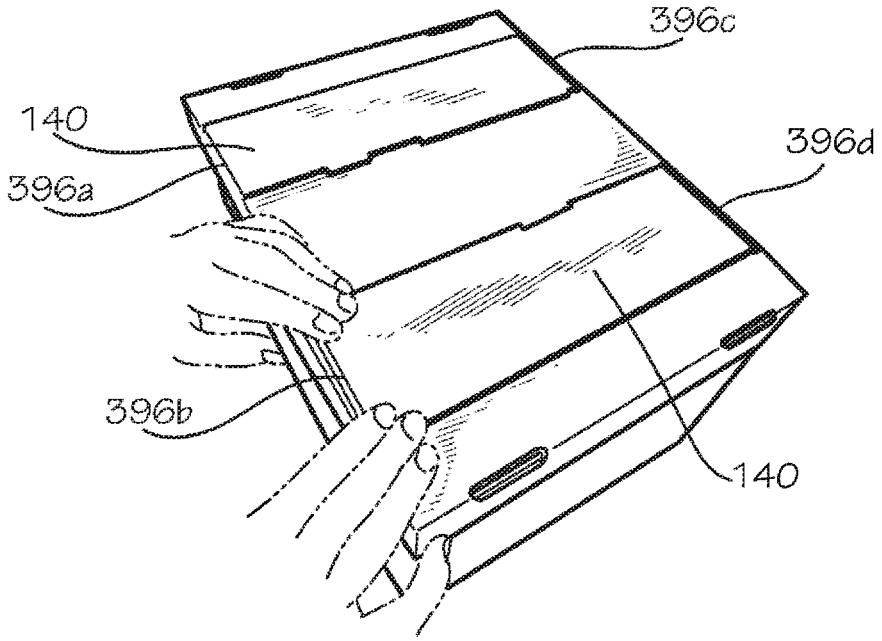
FIG. 8 is a perspective view of the assembled main body of FIG. 4 fully engaged with the assembled tray of FIG. 5.

126*e* between the fastener tab 246 and the crosspiece 242 to prevent the fastener tab 246 from disengaging the fastener slots 396*b*, 256. In other example embodiments, end edges 798 of only one of the fastener slots 396*b*, 256 can engage the notches and/or lips 254. FIG. 8 shows the pair of fasteners 140 fully inserted through fastener slots 396*a*,396*d* and the fastener tabs 246 (shown in FIG. 2) inserted through the opposing fastener slots 396*c*,396*b*, respectively.

FIG. 9 illustrates the storage box 100 fully assembled. The bottom edges 222 (shown in FIG. 2) of the sidewalls 112,114,116,118 can face downward, and the top edges 220 of the sidewalls 112,114,116,118 can face upward, relative to the orientation shown. As described above, a first one of the trays 160 can abut the bottom edges 222 of the sidewalls 112,114,116,118 and can be connected to the main body 110 by the fasteners 140 (shown in FIG. 2). According to example aspects, as shown in FIG. 9, a second one of the trays 160 can rest on the top edges 220 (shown in FIG. 2) of the sidewalls 112,114,116,118 (sidewalls 112,118 are visible in FIG. 9). The top edges 220 of the sidewalls 112,114,116, 118 can abut the inner surface 102 (shown in FIG. 1) of the center panel 362 at or near the side and end edges 364,366 of the center panel 362. Further, as shown, the side panels 370 and end panels 380 can abut or be positioned adjacent to the outer surfaces 604 of the corresponding sidewalls 112,114,116,118. As such, the second one of the trays 160 can be assembled with the main body 110 by resting the tray 160 on the top edges 220 of the sidewalls 112,114,116,118 and can be removed from the main body 110 by lifting the tray 160 away from the top edges 220.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A storage box comprising:

a unitary blank comprising a sidewall enclosure and a fastener panel, the sidewall enclosure folded to define a plurality of sidewalls, the sidewall enclosure defining a top edge and an opposing bottom edge, the fastener panel formed monolithically with the sidewall enclosure and extending from the bottom edge; and a tray comprising a first side panel, a second side panel, and a center panel therebetween, the fastener panel extending across a width of the center panel from the first side panel to the second side panel and coupling the tray to the sidewall enclosure, the tray defining a first side and an opposing second side, a first tray slot formed in the first side, a second tray slot formed in the second side, a first portion of the fastener panel received in the first tray slot and a second portion of the fastener panel received in the second tray slot.

2. The storage box of claim 1, wherein the tray abuts the bottom edge of the sidewall enclosure.

3. The storage box of claim 1, further comprising a second tray, the second tray abutting the top edge of the sidewall enclosure.

4. The storage box of claim 1, the sidewall enclosure comprising four of the sidewalls, the sidewall enclosure defining a rectangular cross-section.

5. The storage box of claim 1, wherein the fastener panel comprises a fastener tab and a crosspiece extending between the fastener tab and the sidewall enclosure.

6. The storage box of claim 5, the crosspiece defining a rectangular shape, the fastener tab defining one of a triangular or trapezoidal shape.

7. The storage box of claim 1, the second tray slot defining a slot edge, the fastener panel defining a notch, the slot edge engaging the notch.

8. The storage box of claim 1, the sidewall enclosure comprising a sidewall slot aligned with the second tray slot.

9. The storage box of claim 1, wherein the sidewall enclosure further defines a second fastener panel extending from the bottom edge.

10. The storage box of claim 9, wherein the second fastener panel extends across the width of the center panel from the second side panel to the first side panel.

11. The storage box of claim 9, the bottom edge defining a first edge section and an opposing second edge section, the fastener panel extending from the first section and the second fastener panel extending from the second section.

12. A storage box comprising:

a unitary blank comprising a sidewall enclosure, a first fastener panel, and a second fastener panel, the sidewall enclosure defining a top edge and an opposing bottom edge, the bottom edge defining a first section and an opposing second section, the first fastener panel connected to the first section at a first bend line, the second fastener panel connected to the second section at a second bend line; and a tray abutting the bottom edge of the sidewall enclosure, the tray comprising a first pair of fastener slots and a second pair of fastener slots, the first fastener panel engaging the first pair of fastener slots, the second fastener panel engaging the second pair of fastener slots.

13. The storage box of claim 12, further comprising a second tray abutting the top edge of the sidewall enclosure.

14. The storage box of claim 12, the first fastener panel comprising a first fastener tab and a first crosspiece between the sidewall enclosure and the first fastener tab, the second fastener panel comprising a second fastener tab and a second crosspiece between the second fastener tab and the sidewall enclosure.

15. The storage box of claim 12, the first fastener panel extending in a first direction across the tray, the second fastener panel extending in a second direction across the tray, the first direction opposite the second direction.

16. A method for assembling a storage box comprising:

providing a unitary blank comprising a sidewall enclosure and a fastener panel, the fastener panel connected to the sidewall enclosure at a bend line;

folding the unitary blank to define a plurality of sidewalls;

forming a tray, the tray comprising a first side panel, a second side panel, and a center panel therebetween, the tray defining a first slot formed in the center panel adjacent the first side panel and a second slot formed in the center panel adjacent the second side panel;

inserting the fastener panel through the first slot;

folding the fastener panel at the bend line and extending the fastener panel across a width of the center panel; and inserting a portion of the fastener panel through the second slot.

17. The method of claim 16, further comprising securing a connector strip of a first one of the sidewalls to a second one of the sidewalls.

18. The method of claim 16, wherein inserting the fastener panel through the first slot comprises inserting a crosspiece and a fastener tab through the first slot.

19. The method claim 18, wherein inserting a portion of the fastener panel through the second slot comprises inserting the fastener tab through the second slot.

20. A storage box comprising:

a unitary blank comprising a sidewall enclosure and a fastener panel, the sidewall enclosure folded to define a plurality of sidewalls, the sidewall enclosure defining a top edge and an opposing bottom edge, the fastener panel formed monolithically with the sidewall enclosure and extending from the bottom edge; and a tray comprising a first side panel, a second side panel, and a center panel therebetween, the fastener panel extending across a width of the center panel from the first side panel to the second side panel and coupling the tray to the sidewall enclosure, wherein the tray defines a first slot formed in the center panel adjacent to the first side panel and a second slot formed in the center panel adjacent to the second side panel, the fastener panel extending through the first slot and the second slot.

21. The storage box of claim 20, wherein the tray abuts the bottom edge of the sidewall enclosure.

22. The storage box of claim 20, further comprising a second tray, the second tray abutting the top edge of the sidewall enclosure.

23. The storage box of claim 20, the sidewall enclosure comprising four of the sidewalls, the sidewall enclosure defining a rectangular cross-section.

24. The storage box of claim 20, wherein the fastener panel comprises a fastener tab and a crosspiece extending between the fastener tab and the sidewall enclosure.

25. The storage box of claim 24, the crosspiece defining a rectangular shape, the fastener tab defining one of a triangular or trapezoidal shape.

26. The storage box of claim 20, wherein the sidewall enclosure further defines a second fastener panel extending from the bottom edge.

27. The storage box of claim 26, wherein the second fastener panel extends across the width of the center panel from the second side panel to the first side panel.

28. The storage box of claim 26, the bottom edge defining a first edge section and an opposing second edge section, the fastener panel extending from the first section and the second fastener panel extending from the second section.

* * * * *